United States Patent [19]

Dilg

[11] 4,267,935

[45] May 19, 1981

[54] RAILWAY CAR ROTARY COUPLER

[75] Inventor: Walter C. Dilg, Elma, N.Y.

[73] Assignee: Dresser Industries, Inc., Dallas, Tex.

[21] Appl. No.: 72,707

[22] Filed: Sep. 4, 1979

[51] Int. Cl.[3] ..... B61G 1/38

[52] U.S. Cl. ..... 213/72; 213/62 R; 213/69; 213/71

[58] Field of Search ..... 213/18, 62, 64, 67, 213/69, 72, 96, 97, 120, 124, 174, 219, 71

[56] References Cited

U.S. PATENT DOCUMENTS

| | | | |
|---|---|---|---|
| 2,727,635 | 12/1955 | Blattner | 213/72 |
| 2,869,736 | 1/1959 | Wolfe | 213/72 |
| 2,973,104 | 2/1961 | Metzger | 213/69 |
| 2,973,105 | 2/1961 | Metzger | 213/71 |
| 3,220,562 | 11/1965 | Baker | 213/62 |
| 4,093,079 | 6/1978 | Cope | 213/62 A |

*Primary Examiner*—Richard A. Bertsch

*Attorney, Agent, or Firm*—J. N. Hazelwood; B. E. Deutsch

[57] ABSTRACT

A rotary railway car coupler has a shank with a butt end portion for mounting to a coupler yoke and a head end portion on its opposite end portion. A coupler head has a guard arm side portion, a knuckle side portion and a knuckle mounted therewith for cooperative connection with another mating railway car coupler. The shank has on its head end portion a mount for rotatably mounting the coupler head. A mount within the coupler head rotatably connects the coupler head and the coupler shank for rotation of the coupler head relative to the shank.

15 Claims, 9 Drawing Figures

RAILWAY CAR ROTARY COUPLER

Technical Field

This invention is related to rotary type railroad car couplers which are constructed to allow a railcar to be rotated about a longitudinal axis relative to another railroad car coupled thereto. Such rotation is utilized to invert the body of a hopper-type railcar for the unloading or dumping out of its contents. This invention concerns a coupler usable on a railroad car in this type of service to permit rotation of the car while also being constructed to interlock with non-rotary type couplers.

BACKGROUND OF THE INVENTION

Prior as well as current designs of rotary couplers have the head portion of the coupler assembly formed with the shank much like the standard AAR E and F type couplers. In these prior art constructions, a major portion of the shank extends from the coupler head into a mating segment of the shank or into a special yoke construction in order to permit rotation of the coupler head. These constructions are subject to jamming and sticking when the relatively small bearing surfaces on the shank become worn or contain foreign matter, or both, which causes difficult rotation of the railroad cars in their intended function. By placing the rotating element of these coupler constructions in the small physical confines of the shank, the loads applied to the small parts are substantial due to normal loading forces involved in typical train action as well as the added forces encountered from the rotating action. A difficulty with the prior art constructions is that they require frequent maintenance attention due to wearing of the parts and this presents some difficulty because the parts are contained within the confines of the railroad car sill structure, thus not readily accessible.

Another disadvantage of the current and the prior art rotary couplers is that they sometimes inadvertently uncouple when rotated if the standard coupling mechanism is utilized. Because of the vibrations and other extrinsic forces that may act on the coupler when a railroad car is rotated to an inverted position, the couplers may become disconnected. When this occurs the train must be recoupled before proceeding with the unloading operation. Some prior art rotary couplers are constructed to be permanently connected so that once the train is made up and the cars are connected, they normally remain in the connected condition. This overcomes the difficulty in inadvertent uncoupling, however, it presents some difficulties when intentionally uncoupling the train due to the nature of the semi-permanently connected couplers.

SUMMARY OF THE INVENTION

In an embodiment, the railroad car coupler of this invention has a shank with a butt end portion that is mounted in a standard configuration and a coupler head assembly mounted on a head end portion of the shank. The head end portion of the shank extends from the railroad car and has features thereon which cooperatively engage internal features of the coupler head assembly so the coupler head assembly can rotate relative to the shank. The coupler head assembly has standard features for cooperatively engaging a standard non-rotatable railroad car coupler such as the AAR type F coupler.

One object of this invention is to provide a railroad car coupler structure which has the rotatable elements of the coupler contained substantially within the confines of the coupler head assembly and on the exterior of an attached railroad car.

One object of this invention is to provide a rotary coupler for railroad cars overcoming aforementioned disadvantages of the prior art rotatable couplers.

Still, one other object of this invention is to provide a rotary coupler for unit train type railroad cars but yet a coupler that will interlock with standard AAR type couplers for easy separation of the train employing such couplers.

Still, another object of this invention is to provide a railroad car rotary coupler that utilizes a substantially standard type F shank and head wherein the rotatable elements between the shank and the head are contained within the head portion of the coupler and the coupler knuckle is fixed in its position.

Various other objects, advantages, and features of this invention will become apparent to those skilled in the art from the following discussion, taken in conjunction with the accompanying drawings, in which:

Figure 1:
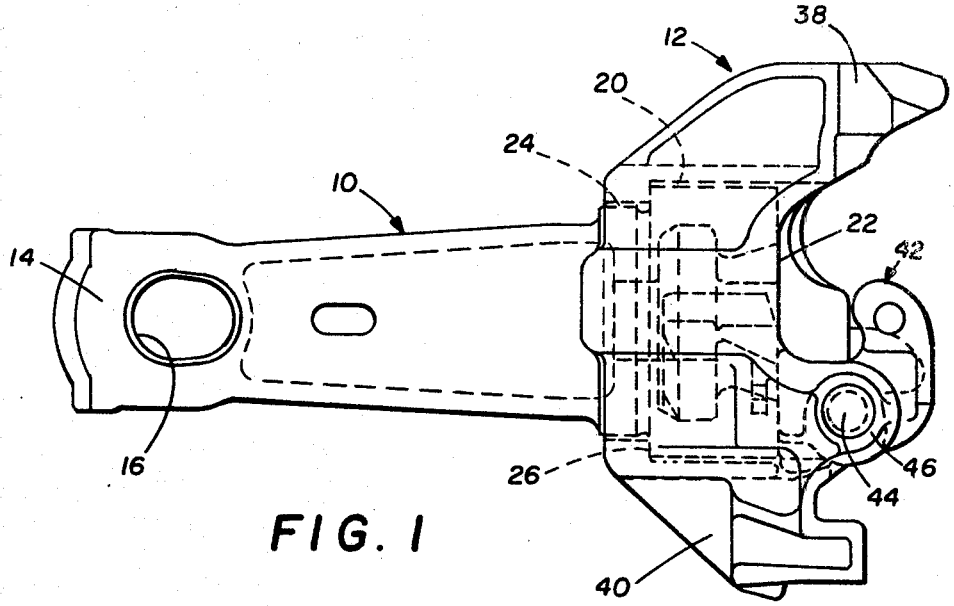
FIG. 1 is a top plan view of the rotary coupler of this invention with the interior interconnecting features in the coupler head assembly shown in dashed lines and the hollow portion of the shank shown in dashed lines.

The following is a discussion and a description of preferred specific embodiments of the railroad car rotary coupler of this invention, such being made with reference to the drawings, whereupon the same reference numerals are used to indicate the same or similar parts and/or structure. It is to be understood that such discussion and description is not to unduly limit the scope of the invention.

DETAILED DESCRIPTION

Figure 2:
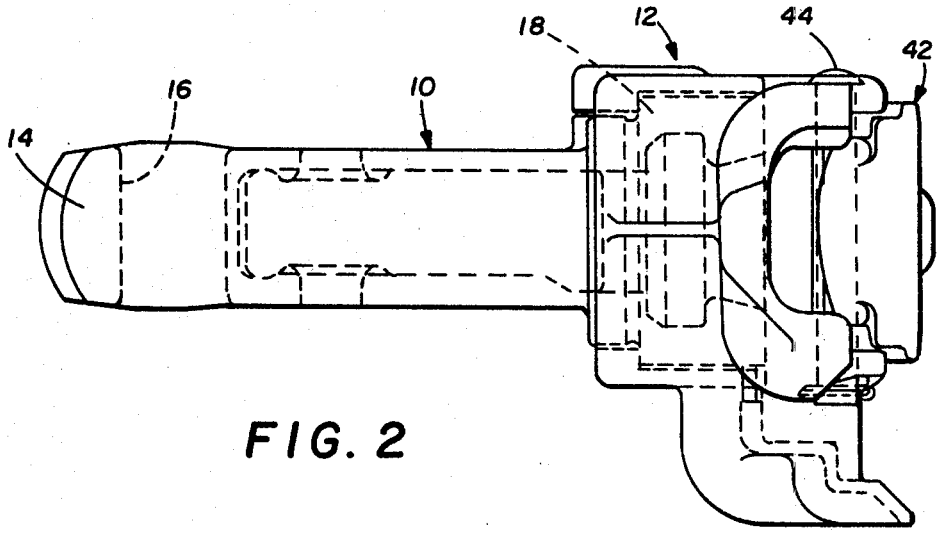
FIG. 2 is a knuckle side elevation view of the rotary coupler with internal and hidden portions thereof showing dashed lines.

The rotary coupler of this invention is shown in FIGS. 1 and 2 and includes a shank, indicated generally at 10, rotatably connected to a coupler head assembly, indicated generally a 12, on the head end portion of the shank. As can be seen in the dashed lines in these figures, the interconnecting elements between the shank 10 and the coupler head assembly 12 are contained substantially within the confines of the coupler head assembly 12 so the coupler head assembly is supported in a rotatable relation on the head end portion of shank 10.

Coupler shank 10 has a coupler butt portion 14 on one end portion thereof and a yoke pin connecting aperture 16 vertically through butt end portion of the shank. Shank 10 has at its opposite end a head end portion 18 with exterior and interior surfaces thereof shaped to cooperatively mount coupler head assembly 12. The exterior of shank head end portion 18 has a large diameter substantially cylindrical exterior surface 20 extending from the shank outboard end 22 toward coupler butt end portion 14. A smaller diameter substantially cylindrical surface 24 is inboard of larger diameter cylindrical surface 20. An annular shoulder 26 on shank head end portion 18 is located between cylindrical surfaces 20 and 24 to form an abutment radially disposed to the longitudinal axis of the shank for contact of a facing abutment on the interior of coupler head assembly 12. Cylindrical surfaces 20 and 24 are substantially coaxial with the longitudinal axis of coupler shank 10.

Figure 6:
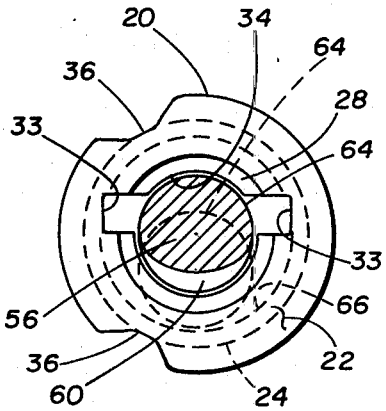
FIG. 6 is a knuckle end elevation view of the shank along with interior hidden portions shown in dashed lines and the tail portion only of the knuckle shown within the internal opening in solid lines in a central position and in a displaced and normal use position in dashed lines.
Figure 8:
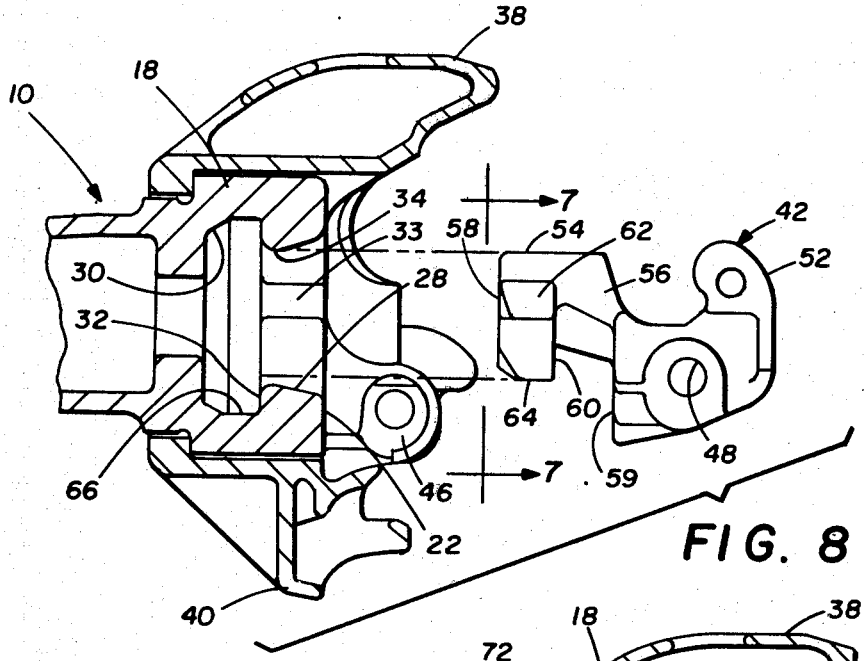
FIG. 8 is an exploded cutaway view of the rotatable coupler head assembly similar to FIG. 3, but with the knuckle displaced from the coupler head and positioned outboard thereof in a location with the tail thereof aligned with the shank opening.

In the interior of the shank head end portion 18, an opening is provided for the receipt and mounting of the tail portion of the coupler knuckle. The shank internal opening extends through the center portion of the shank and includes an entry portion 28 that communicates with shank end 22 and connects with an internal annular opening 30 extending transverse to the shank internal opening within shank head end portion 18. One surface defining annular opening 30 is an annular surface transverse to the longitudinal axis of the shank and facing toward coupler butt end portion 14 thereby defining a shank internal annular shoulder 32. Referring to FIGS. 6 and 8, the shank internal opening has a pair of longitudinally disposed slots 33 on opposed sides thereof extending between shank end surface 22 and annular opening 30. These slots 33 are essentially rectangular in form as seen in FIG. 6 and function to receive side lugs on the knuckle tail portion. Slots 33 are positioned in an offset relation to the geometrical longitudinal center of shank head end portion 18. Slots 33 extend from the smallest diameter porion 34 of the shank opening entry portions outward to a radially mid-portion of shank end surface 22.

On the exterior of shank head end portion cylindrical surface 20, are a pair of grooves 36 on opposite side portion of shank head end portion 18. Grooves 36 extend in general longitudinal alignment with the longitudinal axis of coupler shank 10. Grooves 36 are located in a generally transverse orientation to the position of slots 33 so grooves 36 will be in a vertical relation to each other when coupler shank 10 is installed on a railroad car. Grooves 36 provide clearance for pivot lugs and pin protectors on coupler head assembly 12 in order to facilitate entry of shank 10 into coupler head assembly 12.

Figure 5:
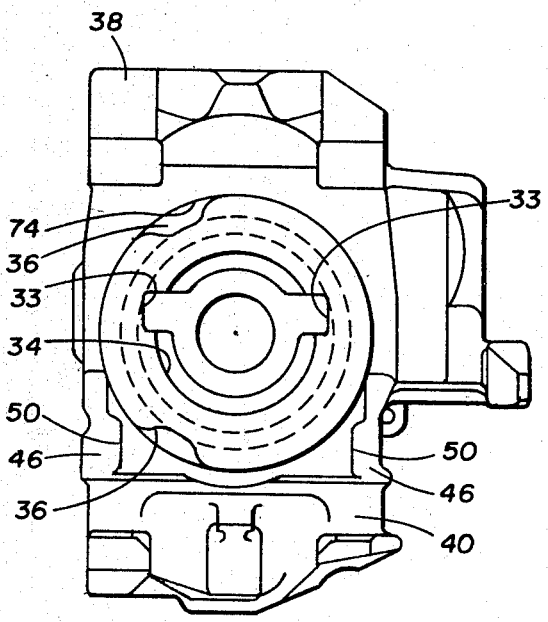
FIG. 5 is a knuckle end elevation view of the rotary coupler with the shank positioned within a coupler head and the knuckle removed.

Coupler head assembly 12 is illustrated with the basic features of a standard AAR type F coupler head assembly including a guard arm portion 38 on one side thereof, a knuckle side portion 40 on the opposite side thereof and with a knuckle, indicated generally at 42. Knuckle 42 is secured to knuckle side portion 40 of the coupler head assembly 12 by a knuckle pivot pin 44 that extends through pivot lugs 46 on the upper and lower portions of the coupler head and through a knuckle pivot pin opening 48 through the knuckle. Pivot lugs 46 each have a pin protector 50 extending generally inwardly toward the center portion of the coupler head assembly as shown in FIG. 5.

Figure 3:
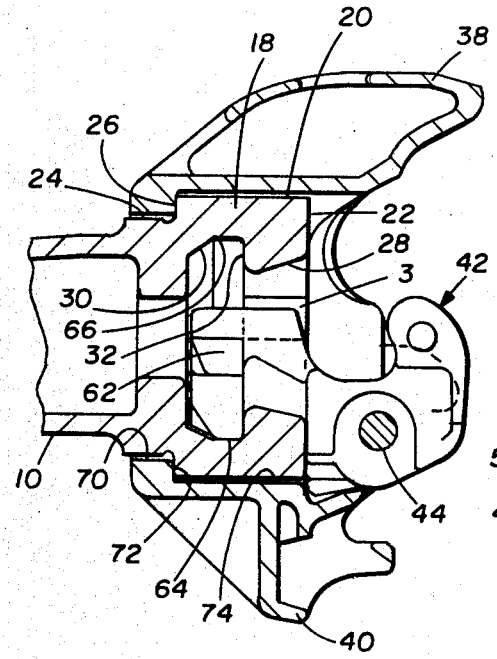
FIG. 3 is a cutaway elevation view of the head end portion of the rotary coupler with the view taken horizontally and looking downward through a transverse mid-portion of the coupler.
Figure 4:
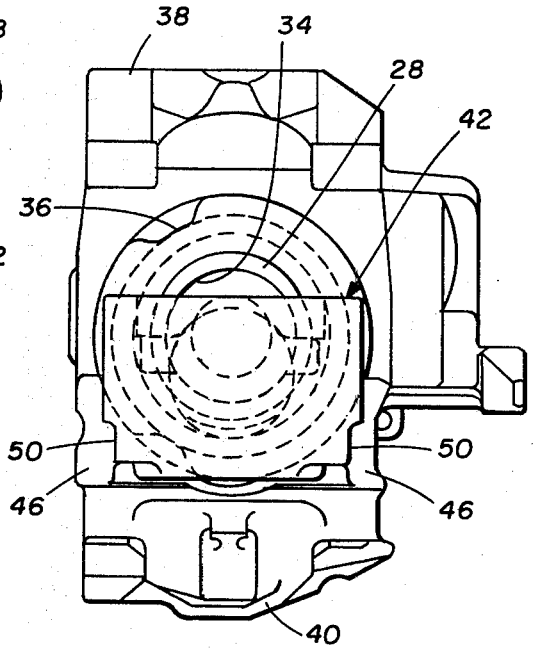
FIG. 4 is a knuckle end elevation view of the rotary coupler with internal and hidden portions thereof shown in dashed lines and the coupler positioned to correspond with FIG. 3.
Figure 7:
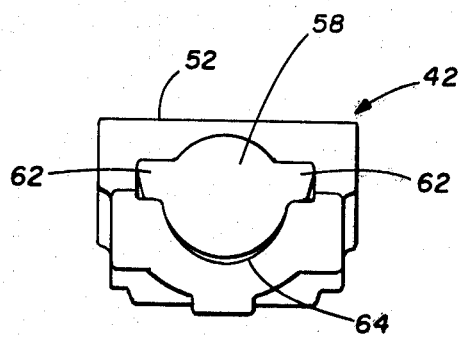
FIG. 7 is an elevation view of the coupler knuckle taken from the tail end thereof and with the view taken from the location illustrated at lines 7—7 in FIG. 8.

Referring to FIG. 8, knuckle 42 has a nose 52 of the conventional style on the outboard portion thereof and a modified tail portion 54 on the inboard portion thereof. Knuckle tail 54 includes a stem portion 56 extending in the inboard direction from the center body section of the knuckle and a knuckle tail tip portion 58 extending generally transverse to the longitudinal axis of the coupler and cooperatively engaged within the shank annular opening 30. On the inboard side of knuckle center body portion is an inboard shoulder 59 that faces shank end surface 22. Knuckle tail tip portion 58 has a shoulder 60 on the outboard facing side thereof to cooperatively engage shank internal annular shoulder 32 for transmitting draft loads between knuckle 42 and shank 10. On upper and lower sides of knuckle tail tip portion 58 generally aligned with the longitudinal vertical disposition of nose 52 are knuckle side lugs 62. Knuckle side lugs 62 are positioned in an off-center relation to the rear or inboard side of knuckle 42 as shown in FIG. 7. Knuckle side lugs 62 pass through slots 33 in shank head end portion 18 for mounting of knuckle 42 on the shank. Knuckle side lugs 62 are positioned adjacent shank internal annular shoulder 32 when the knuckle is in its final resting position in the coupler shank as shown in FIGS. 3 and 4. Knuckle tail tip portion 58 when seen from the rear or inboard end thereof as in FIG. 7, has a nearly circular appearance, not including knuckle side lugs 62. Curvature of surface 64 is about a geometric center displaced from that of the other peripheral surfaces around knuckle tail tip portion 58. Surface64 has a curvature which corresponds in curvature to the outer peripheral curvature 66 of shank annular opening 30. The relationship of these surfaces can be seen in FIG. 6 wherein knuckle tail tip portion 58 is shown in solid lines within shank internal opening 30 and in dashed lines in a displaced condition representing the normal operating position of these parts.

Figure 9:
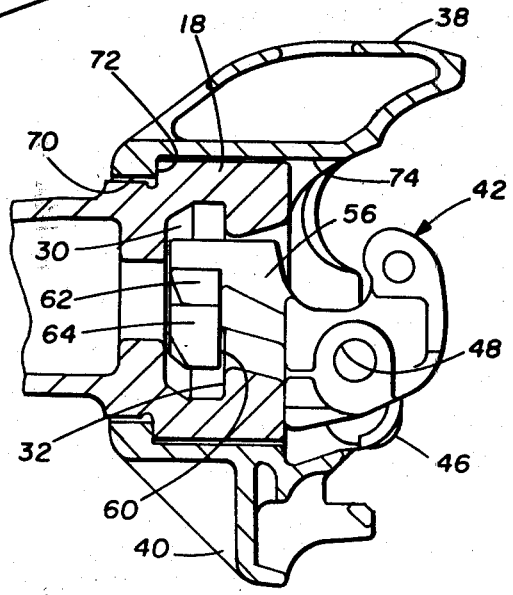
FIG. 9 is a cutaway elevation view of the rotary coupler head assembly similar to FIG. 8, however with he knuckle positioned within the center portion of the shank opening as it is during assembly prior to its being displaced to the final resting position and for insertion of the knuckle pin.

In placing knuckle 42 into the coupler, it is aligned with the elements in a position shown in FIG. 8 so knuckle side lugs 62 can pass through slots 33. For this to be done, the coupler head assembly and shank must be positioned as shown in FIG. 5 so the knuckle will be properly oriented relative to pivot lugs 46 and for knuckle pivot pin 44 to be inserted. Once knuckle 42 is placed within shank head end portion 18, it is initially in the position shown in FIG. 9. In this position knuckle side lugs 62 having just passed through slots 33, the inboard side of knuckle tail tip portion 58 is resting against or closely adjacent to the inboard side of shank annular opening 30 and knuckle inboard surface 59 is adjacent to shank end 22. From this position the knuckle is moved transversely for insertion of knuckle pivot pin 44.

The interior of coupler head assembly 12 in the mid-body portion thereof has a pair of cylindrical cross-sectionally circular interior surfaces for mounting with coupler shank head end portion 18. The small diameter of these interior surfaces 70 opens at one end to the inboard end of coupler head assembly 12 and extends in the outboard direction to an annular transversely disposed surface 72 forming a shoulder extending outward to the interior of the larger diameter internal surface 74. Larger diameter internal surface 74 extends from annular surface 72 and opens to the outboard end portion of coupler head assembly 12. At this point it is to be noted that the exterior of coupler butt 14 is sized so that it will pass through coupler head smaller internal surface 70 to allow shank 10 to be mounted with coupler head assembly 12.

In assembly of the railroad car coupler of this invention, coupler shank 10 is inserted into and through coupler head assembly 12. In doing this, coupler shank 10 must first be oriented in an assembly position relative to coupler head assembly 12. This assembly position is with grooves 36 in coupler head end portion 18 aligned with pin protectors 50. Referring to FIG. 5 this position for assembly is essentially with coupler head assembly rotated approximately 90° clockwise of the position shown in FIG. 5 so as to align grooves 36 and pin protectors 50. This will enable shank head end portion 18 to be passed into the interior confines of the coupler head assembly. Once coupler shank 10 has been inserted to the position where annular shoulders 26 and 72 are in contact, then coupler head assembly 12 and shank 10 are rotated to the position shown in FIGS. 5 and 8 then coupler knuckle 42 can be installed. Installation of coupler knuckle 42 involves aligning the knuckle with the rest of the assembly as shown in FIG. 8 then moving knuckle 42 into shank annular opening 30 with knuckle side lugs 62 passing through slots 33 and then displacing the knuckle in a transverse relation to position knuckle pivot pin passage 48 between the openings in pivot lugs 46 so that knuckle pivot pin 44 can be installed. When this has been done, the coupler assembly appears as shown in FIGS. 1–4 and the coupler head assembly can be rotated relative to shank 10 a full 360° if desired.

In normal operation on a train, the railroad car coupler of this invention is positioned as shown in FIGS. 1–4 and draft loads taken by knuckle 42 are transmitted through its attached stem 56 and knuckle shoulder 60 and knuckle side lugs 62 to shank 10 at internal annular shoulder 32. Also some of the draft loading applied to knuckle 42 is taken through pin protecter lugs 50 and coupler head assembly 12 and transmitted to shank 10 by shoulder 72 in the coupler head assembly and annular shoulder 26 on shank head end portion 18. Buff loading of knuckle 42 and coupler head assembly 12 is transmitted to shank end surface 22 from knuckle inboard shoulder 59.

When the rotary coupler of this invention is utilized, it is preferably placed on only one end of the cars in a substantially permanently connected unit train utilized for transportation of bulk materials and rotary dumping of the cars. The other coupler on the car can be a standard F type railroad car coupler which will interconnect with the railroad car coupler of this invention without difficulty or special provisions. For purposes of this discussion, assume the rotary coupler to be mounted on the forward end of the cars in the train and the standard non-rotary coupler is mounted on the rear of the cars. When a car is to be dumped, it is placed on the rotating apparatus and rotated longitudinally relative to the other cars about the car's sill and the couplers. When this occurs, the coupler head assembly 12 remains stationary due to its interconnection with the non-rotary coupler on the rear of the preceding car and coupler shank 10 rotates with the car. Due to the rotatable elements of this invention being within the confines of the coupler head assembly 12 the car being rotated does so freely without restriction. Coupler shank head end portion 18 turns within the interior of coupler head assembly 12 and around knuckle tail 54 within the shank annular opening 30. On the rear of the car being rotated, the non-rotary coupler rotates the coupler head and knuckle assembly on the trailing car while the coupler shank on this trailing car remains stationary. Once the car being dumped is rotated back to the upright position, the rotary couplers involved assume the position for normal operation as shown in FIG. 1 and the train is moved for dumping of the remaining cars.

One feature of the rotary railroad car coupler of this invention that becomes apparent upon operation thereof is that rotation takes place smoothly without the coupler shank being rotated against the coupler carrier of the car having the rotary coupler as it does in the prior art rotary couplers. This is occasioned because the shank of the rotary coupler of this invention does not rotate. Also, it is to be noted that when the car being dumped is rotated back to an upright position, coupler head assembly 12 is positioned in its normal upright operating position due to interconnection with the connected standard non-rotatable coupler. In the event of damage to an attached non-rotatable coupler such that for some reason causes it to assume a partially rotated position, this will not necessarily adversely affect the ability of the rotatable coupler of this invention to maintain the train in its connected condition because this coupler will function regardless of the relative rotated position of the coupler head assembly and coupler shank 10.

In the foregoing, it has been seen that a railroad car rotary coupler has been provided for use in trains where rotation of selected cars is utilized for unloading. The rotary coupler of this invention has all the rotatable elements thereof contained substantially within the confines of the coupler head assembly. This rotary coupler is fully operably connectable with standard type non-rotary railroad car couplers. The rotary coupler in the depicted embodiment is provided with a coupler head assembly having features of a standard AAR type F coupler for interconnection with non-rotary type standard type F couplers. However, it is to be understood that if desired, a rotary coupler having the features of this invention can be utilized in coupler constructions having interconnecting features other than those of the type F coupler, such as the type E without departing from the scope of this invention.

The embodiments of the invention in which an exclusive property or privilege is claimed are defined as follows:

1. A railroad car coupler, comprising:

(a) a shank having a butt end portion at one end for mounting with a coupler yoke and a head end portion at the opposite end, said head end portion including an axially extending peripheral bearing surface; and (b) coupler head means having a guard arm side portion, knuckle side portion and a knuckle for cooperative interconnection with an operable mating coupler having similar elements, said coupler head means further including an axially extending bearing surface complementary to said bearing surface of said head end portion of said shank, said respective bearing surfaces enabling relative motion to occur between said shank and said coupler head means;

(c) means on said shank at said shank head end portion thereof to rotatably mount said coupler head means; and (d) means within said coupler head means to mount with said means at said shank head end portion to rotatably mount said coupler head means.

2. The railroad car coupler of claim 1, wherein said bearing surface of said shank head end portion is substantially cylindrical and includes an annular shoulder extending inward therefrom transverse to the longitudinal axis of said shank and facing said butt end portion thereof wherein said cylindrical surface and said annular shoulder form coupling and mounting surfaces for permitting rotation of said coupler head means relative to said shank and for supporting said coupler head means on said shank for draft action of said railcar coupler.

3. The railroad car coupler of claim 2, wherein:

(a) said shank head end portion has a mid-portion with a substantially cylindrical surface therearound at an inner peripheral portion of said annular shoulder and extending toward said shank butt end portion;

(b) said shank has exterior peripheral portions of said butt end portion sized not substantially greater than the diameter of said mid-portion of said substantially cylindrical surface such that said shank butt end portion will pass through an opening that is approximately the diameter of said mid-portion of said substantially cylindrical surface; and (c) said shank head end portion has a longitudinally disposed opening therein communicating to the head end thereof with an internal annular shoulder around the periphery of the opening inside the shank wherein said shoulder faces said shank butt end portion, said internal annular shoulder being adapted to cooperatively engage a portion of said knuckle.

4. The railway car coupler of claim 1, wherein:

(a) said coupler head means defines an opening including a portion of circular cross-section extending longitudinally of said shank;

(b) said coupler head means bearing surface includes an annularly extending shoulder transverse to the longitudinal axis of said shank extending inward of said circular cross-section portion and facing toward said opposite end of said shank; and (c) said shank head end portion being disposed within said opening defined by said coupler head means.

5. The railway car coupler of claim 1, wherein said head end portion of said shank defines an opening for receiving and rotatably mounting a tail portion of said knuckle.

6. The railway car coupler of claim 5, wherein:

(a) said shank includes a radially extending shoulder disposed within said shank opening; and (b) said knuckle tail portion has a shoulder facing towards said shank shoulder so that said facing surfaces may be engaged during draft action of said railway coupler.

7. The railway car coupler of claim 1, wherein:

(a) said mounting means on said shank at said shank head end portion has a substantially cylindrical exterior surface portion therearound;

(b) said mounting means on said shank head end portion has an annular shoulder extending inward of said substantially cylindrical surface and transverse to the longitudinal axis of said shank at the end of said substantially cylindrical surface facing said butt end portion wherein said cylindrical surface and said annular shoulder form coupling and mounting surfaces for permitting rotation of said coupler head means relative to said shank and for supporting said coupler head on said shank for draft action of said railcar coupler;

(c) said mounting means within said coupler head means has an opening within said coupler head means including a portion of circular cross-section extending longitudinally of said coupler;

(d) an annular shoulder transverse to the longitudinal axis of said coupler, extending inward of said circular cross-section portion and facing away from said shank butt end portion;

(e) an opening in a rear portion of said coupler head means through which said shank head end portion extends into said coupler head means;

(f) said knuckle is mounted with said coupler head means knuckle side portion and has a nose portion extending from said railway car coupler for cooperative interconnection with another railway car coupler, and a tail portion extending into the interior of said coupler head means; and (g) said means on said shank head end portion to rotatably mount said coupler head means has an opening within said shank head end portion to receive and rotatably mount said knuckle tail portion for rotating motion of said coupler head means including said knuckle tail portion relative to said shank and for mounting said knuckle for draft action of said knuckle.

8. The railroad car coupler of claim 7, wherein:

(a) said mounting means within said coupler head means has an opening longitudinally through said coupler head means so that with said knuckle removed from said coupler head means, said shank butt end portion and the portion of said shank between said butt end portion and said head end portion can be passed through said opening with said shank head end portion resting within said coupler head means;

(b) said coupler mounting means within said coupler head means has a second diametrically smaller portion of circular cross-section extending longitudinally of said coupler from the inner periphery of said annular shoulder and toward said shank butt end portion to fit around an external peripheral surface of said shank;

(c) said shank head end portion has a mid-portion with a substantially cylindrical surface therearound at an inner peripheral portion of said annular shoulder and extending toward said shank butt end portion, said mid-portion adapted to operably fit within said coupler head means second diametrically smaller opening;

(d) said shank has exterior peripheral portions of said but end portion sized but substantially greater than the diameter of said mid-portion substantially cylindrical surface such that said shank butt end portion will pass through an opening that is approximately the diameter of said mid-portion substantially cylindrical surface;

(e) said shank head end portion has a longitudinally disposed opening therein communicating to the head end thereof with an internal annular shoulder around the periphery of the opening inside the shank wherein said shoulder faces said coupler butt end portion, said internal annular shoulder being adapted to cooperatively engage a portion of said knuckle tail portion for rotation of said coupler head means relative to said shank wherein said knuckle tail portion has a shoulder facing away from said coupler butt end portion and disposed in spaced relation to said shank internal annular shoulder so that said facing surfaces of said knuckle tail portion and said annular shoulder may be engageable with each other during draft action of said railway car coupler.

9. A railroad car coupler in accordance with claim 1, wherein said shank includes a transversely extending end surface in engagement with a complementary surface formed on said knuckle, forces generated by buff loading on said coupler being transmitted to said shank through engagement of said respective surfaces.

10. A railroad car coupler comprising:

(a) a shank having a butt end portion for mounting with a coupler yoke and a head end portion on the opposite end portion thereof;

(b) a coupler head means having a guard arm side portion, a knuckle side portion and a knuckle for cooperative interconnection with another mating coupler having similar elements;

(c) means on said shank at said shank head end portion thereof to rotatably mount said coupler head means including, a substantially cylindrical exterior surface portion therearound, an annular shoulder extending inward of said substantially cylindrical surface and transverse to the longitudinal axis of said shank at the end of said substantially cylindrical surface facing said butt end portion wherein said cylindrical surface and said annular shoulder form coupling and mounting surfaces for permitting rotation of said coupler head means relative to said shank and for supporting said coupler head on said shank for draft action of said railcar coupler;

(d) means within said coupler head means to mount with said means at said shank head end portion to rotatably mount said coupler head means including, an opening within said coupler head means having a portion of circular cross-section extending longitudinally of said coupler, an annular shoulder transverse to the longitudinal axis of said shoulder, extending inward of said circular cross-section portion and facing away from said shank butt end portion, and an opening in a rear portion of said coupler head means through which said shank head end portion extends into said coupler head means;

(e) said knuckle is mounted with said coupler head means knuckle side portion and has a nose portion extending from said railway car coupler for cooperative interconnection with another railway car coupler, and a tail portion extending into the interior of said coupler head means; and (f) said means on said shank head end portion to rotatably mount said coupler head means has an opening within said shank head end portion to receive and rotatably mount said knuckle tail portion for rotating motion of said coupler head means including said knuckle tail portion relative to said shank and for mounting said knuckle for draft action of said knuckle.

11. In a railroad car coupler having a shank with a butt end portion for mounting with a coupler yoke and a head means located on the opposite end portion thereof with means to rotatably mount said coupler head means:

(a) said shank has a head end portion that has a mid-portion with a substantially cylindrical surface therearound a smaller diameter inner peripheral portion and an internal shoulder therebetween facing said shank butt end portion;

(b) said shank head end portion also has a longitudinally disposed opening therein communicating to the head end thereof wherein this opening has an annular portion to receive and rotatably mount a tail portion of the coupler knuckle including an internal annular shoulder around the periphery of the opening inside the shank wherein said shoulder faces said coupler butt end portion, said internal annular shoulder being adapted to cooperatively engage an oppositely facing surface on the coupler knuckle tail portion;

(c) said coupler head means has a guard arm side portion, a knuckle side portion and a knuckle for cooperative interaction with another coupler having similar elements, however not necessarily being rotatable, said coupler head means including an opening through said coupler head means an opening therethrough having a portion of circular cross-section extending longitudinally of said coupler, and annular shoulder transverse to the longitudinal axis of said coupler, extending inward of said circular cross-section portion and facing away from said shank butt end portion, a second diametrically smaller portion of circular cross-section extending longitudinally of said coupler from the inner periphery of said annular shoulder and toward said shank butt end portion to the inboard end of the coupler head means to fit around the external peripheral surface of said shank; and (d) said knuckle is mounted with said coupler head means knuckle side portion and has a nose portion extending for cooperative connection with another railway car coupler and a tail portion extending into said shank opening, said knuckle tail portion is passable through said shank internal opening into its interior portion and has a partially annular surface operably engageable with said shank annular shoulder to facilitate load transfer between said shank and said knuckle during draft action of said coupler.

12. A railroad car rotary coupler, comprising:

(a) a shank having a butt end portion at one end for mounting with a railroad car and a head end portion defining the opposite end thereof;

(b) a coupler head means having a guard arm side portion, a knuckle side portion and a knuckle for cooperative interconnection with another railroad car coupler; and (c) said head end portion including male coupling means disposed at said opposite end and said coupler head means including female coupling means operably connected to said male coupling means to rotatably mount said coupler head means on said shank for rotation of said coupler head means relative to said shank to achieve rotation of a railroad car having said rotary coupler relative to another railroad car connected therewith about the longitudinal axes of the cooperatively connected couplers.

13. A railroad car coupler in accordance with claim 12, wherein said shank includes a transversely extending end surface in engagement with a complementary surface formed on said knuckle, forces generated by buff loading on said coupler being transmitted to said shank through engagement of said respective surfaces.

14. A railroad car rotary coupler, comprising:

(a) a shank having a butt end portion at one end for mounting with a railroad car and a head end portion at the opposite end thereof;

(b) coupler head means having a guard arm side portion, a knuckle side portion and a knuckle having the general configuration of a type F railroad car coupler for cooperative interconnection with a type F railroad car coupler; and (c) said head end portion including male coupling means disposed at said opposite end and said coupler head means including female coupling means operably connected to said male coupling means to rotatably mount said coupler head means on said shank for rotation of said coupler head means relative to said shank to achieve rotation of a railroad car having said rotary coupler relative to another railroad car connected therewith about the longitudinal axes of the cooperatively connected couplers.

15. A railroad car coupler in accordance with claim 14, wherein said shank includes a transversely extending end surface in engagement with a complementary surface formed on said knuckle, forces generated by buff loading on said coupler being transmitted to said shank through engagement of said respective surfaces.

* * * * *

UNITED STATES PATENT OFFICE

CERTIFICATE OF CORRECTION

Patent No. 4,267,935 Dated May 19, 1981

Inventor(s) Walter C. Dilg

It is certified that error appears in the above-identified patent and that said Letters Patent are hereby corrected as shown below:

In the claims:

Column 8, line 65, "but" should read "not".

Column 10, line 52, "shoulder" should read "coupler"

Signed and Sealed this

*Eighteenth* Day of *August 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,267,935

DATED : May 19, 1981

INVENTOR(S) : Walter C. Dilg

It is certified that error appears in the above—identified patent and that said Letters Patent is hereby corrected as shown below:

Claim 1, lines 6-11 (c and d should be deleted)

In the following change the word "railway" to read "railroad".

Claim 4, line 45
Claim 5, line 57
Claim 6, lines 61 and 67
Claim 7, Line 68
Claim 7, lines 28 and 29
Claim 8, line 18
Claim 10, lines 60 and 61
Claim 11, line 46

Signed and Sealed this

*Fifth* Day of *April 1983*

[SEAL]

*Attest:*

*Attesting Officer*

GERALD J. MOSSINGHOFF

*Commissioner of Patents and Trademarks*